United States Patent [19]

Langstroth

[11] 4,193,514

[45] Mar. 18, 1980

[54] LIQUID AND GAS DISPENSING VALVE

[76] Inventor: Hall Langstroth, 1454 Alegriano Ave., Coral Gables, Fla. 33146

[21] Appl. No.: 969,857

[22] Filed: Dec. 15, 1978

[51] Int. Cl.[2] ..... B65D 83/14

[52] U.S. Cl. ..... 222/4; 222/48; 222/153; 222/396

[58] Field of Search ..... 222/4, 3, 394, 396, 222/402.17, 402.18, 48, 153

[56] References Cited

U.S. PATENT DOCUMENTS

| | | | |
|---|---|---|---|
| 946,661 | 1/1910 | Desmond | 222/3 |
| 1,353,320 | 9/1920 | Crommett | 222/3 X |
| 3,021,870 | 2/1962 | Allen | 222/4 X |
| 3,428,225 | 2/1969 | Winters et al. | 222/402.17 |
| 3,460,721 | 8/1969 | Hamel et al. | 222/402.18 |

*Primary Examiner*—Joseph J. Rolla
*Assistant Examiner*—Frederick R. Handren
*Attorney, Agent, or Firm*—Ernest H. Schmidt

[57] ABSTRACT

A metallic valve body member adapted to be welded for secure attachment against the top opening of pressurized liquid and gas supply tank is so designed as to provide for the assemblage of all non-integral parts after the welding operation, thereby permitting such additional parts to be fabricated of comparatively inexpensive materials such as synthetic plastics. A valve stem seats at its lower end against a valve seat within the valve body. Outer and inner elongated spool valve members are fixed, respectively, to lower end portions of the valve body member and the valve stem member to project within the interior of the tank. The outer spool valve sleeve is provided with a plurality of peripherally-arranged through openings, through which pressurized gas flows for dispensing past the valve seat upon the valve stem being partially open, and which openings are blocked by a lower end portion of the inner valve spool member when the valve stem is more fully opened to provide for the dispensing of pressurized liquid through the lower end of the outer spool valve member and side wall openings in the inner spool valve member. A dip tube extending from the lower end of the outer spool valve member to the bottom of the tank provides for such dispensing of pressurized liquid while the tank is in upright position. Transition zone adjustment of the valve stem provides for dispensing of a mixture of pressurized gas and liquid, as desired.

10 Claims, 5 Drawing Figures

LIQUID AND GAS DISPENSING VALVE

This invention relates to pressurized liquid dispensing valves, and is directed particularly to a single ported control valve for dispensing from containers filled with Freon or other gases which partially liquify under pressure. Refrigerants such as Freon commonly used in air-conditioning and other cooling and reverse cycle heating equipment are supplied in pressurized steel tanks of various sizes. Fixed at the top of such a tank is a single purpose valve which serves to dispense contained Freon either in gaseous or liquid form, depending upon whether the tank is supported in an upright position or held in tilted or upside down position so that the valve in the port within the tank is below the liquid level. Precise control of flow of a mixture of liquid Freon and its vapor or gas, or the liquid Freon alone in charging a refrigeration system can therefore be achieved only with great difficulty. Such refrigerant supply tanks, moreover, for safety purposes are not reusable, and are therefore constructed as economically as possible. To this end the internal parts of the valve are usually fabricated of synthetic plastic materials, such as by injection molding techniques, with only the valve body being fabricated of a comparatively inexpensive metal such as steel, and this steel body is welded to an opening at the top of the tank for further economy and to eliminate any possibility of its loosening or removal from the tank. For these reasons such valves also had to be so designed so that the internal, non-metallic parts could be assembled after welding of the valve body to the housing, to obviate destruction of such internal valve parts by the heat of welding.

It is accordingly, the principal object of this invention to provide a novel and improved pressurized liquid and gas dispensing valve for refrigerant tanks.

A more particular object of the invention is to provide a pressurized liquid and gas dispensing valve for refrigerant tanks that will permit the selective dispensing of the refrigerant gas or vapor, a mixture of the gas or vapor with the liquid, and the liquid alone, without the necessity of tipping of the tank, all under the control of rotative valve handle.

Yet another object of the invention is to provide a pressurized liquid and gas dispensing valve of the above nature wherein the internal valve parts can all be assembled to the metal valve body after it has been welded to the supply tank, thereby providing for fabrication of such internal parts of comparatively inexpensive synthetic plastic materials.

A more particular object of the invention is to provide a pressurized liquid and gas dispensing valve of the character described comprising outer and inner spool valve sleeve members which extend through the bottom of the valve assemblage and into the top portion of the tank, the outer spool valve sleeve member having a plurality of peripherally arranged through openings through which pressurized gas may flow in partially open positions of the valve stem, which through openings become blocked as the valve stem is more fully opened so that pressurized liquid only will be dispensed through a dip tube connected to the lower end of the outer spool valve member and through side wall openings in the inner spool valve member.

Yet another object is to provide a pressurized liquid and gas dispensing valve of the above nature including a pressure relief valve within the upper end of the valve stem and in communication with the interior of the inner spool member through the peripheral through openings of the outer spool valve member and the peripheral openings in the inner valve member when the valve is in shutoff position.

Yet another object of the invention is to provide a pressurized liquid and gas dispensing valve of the character described including a check valve in the dispensing port, which serves to prevent the reverse flow of gas or fluid and thereby obviates reuse of the tank.

Other objects, features and advantages of the invention will be apparent from the following description when read with reference to the accompanying drawings. In the drawings, wherein like reference numerals denote corresponding parts throughout the several views.

Figure 1:
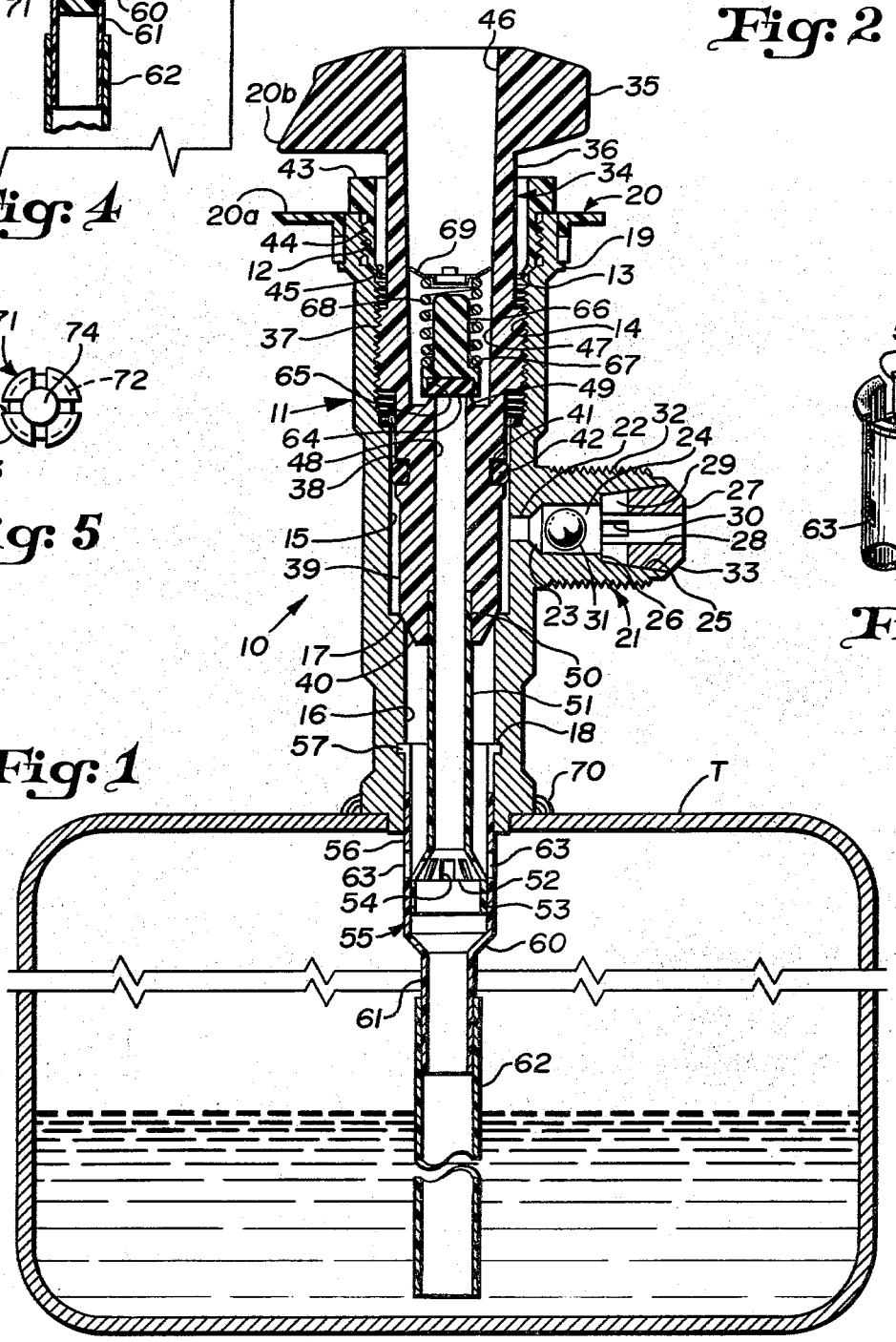
FIG. 1 is a vertical cross-sectional view of the dispensing valve, shown assembled to a refrigerant supply tank.

Referring now in detail to the drawings, reference numeral 10 in FIG. 1 designates, generally, a flow control valve comprising the invention, the same being shown assembled to a cylindrical steel tank T of the type commonly used as a dispensing container for liquid and gaseous refrigerant, such as Freon. The control valve 10 comprises a generally cylindrical valve body member 11 having a concentric through opening defined by an internally-threaded upper end section 12 the inner end of which merges with a comparatively short, inwardly-tapered section 13 merging with a comparatively long, second internally-threaded portion 14. The inner end of the second internally-threaded portion 14 communicates with a reduced-diameter portion 15 the lower end of which communicates with a still further reduced-diameter portion 16 through a short, beveled portion 17 defining a tapered, annular valve seat. The reduced-diameter end portion 16 is formed, intermediate its length, with a small, annular groove 18, for the purpose hereinafter appearing.

The outer periphery of the valve body member 11, near the upper end thereof, is formed with a slightly outwardly projecting circular flange portion 19 defining an annular shoulder for the seating of a frictionally retained dial indexing collar 20.

The cylindrical valve body member 11 is integrally formed with a sidewardly outwardly extending cylindrical port 21 having a central bore 22 communicating with the reduced-diameter, interior portion 15 of said valve body member. The central port bore 22 extends outwardly into a beveled annular valve seat 23 which merges with a concentric, increased-diameter bore 24. The outer end of the central bore 24 extends into a concentric tapered bore 25 of increased size defining therewith, at their junction, an annular seat 26. Fitted within the tapered bore 25 is a complemental, tapered plug 27 having a co-axial, through bore 28. The inner end of the tapered plug 27 is cross-slotted, as indicated by cross cuts 29 and 30, for the purpose hereinafter appearing. Confined within the central bore 24 of cylindrical port 21 is a spherical ball 31, which may be fabricated of steel on a synthetic plastic such as Nylon. The above described port assemblage serves as both a dispensing port for pressurized fluid and gas as is hereinafter more particularly described, and a check valve to prevent reuse of the control valve-tank assemblage by refilling. To this end, the ball 31 is of such diameter as to seal against valve seat 23, thereby preventing inward flow if an attempt were made to force pressurized liquid or gas through valve body 11 into the tank T. The flow of pressurized gas or liquid outwardly through cylindrical port 21, on the other hand, is unimpeded, since seating of the ball 31 against the inner end of the tapered plug 27 cannot prevent flow through cross-cut slots 29, 30 and through bore 28. For use in dispensing, the cylindrical port 21 is externally threaded, as indicated at 32, and the outer tip of the port and tapered plug assemblage is beveled, as indicated at 33, for the interfitting connection of a standard Freon dispensing hose (not illustrated).

Received within the upper end of the cylindrical valve body member 11 is an elongated valve stem member 34, which will preferably be formed of a tough, synthetic plastic material such as Nylon. The valve stem member 34 comprises a knob portion 35 at the upper end, which merges with a reduced-diameter, shank portion 36. The lower end of the shank portion 36 merges with a slightly increased-diameter, externally-threaded portion 37, which is threadingly received in internally threaded portion 14 of cylindrical valve body member 11. The lower end of externally-threaded portion 37 merges with a first reduced-diameter stem portion 38 which, in turn, merges with a second reduced diameter portion 39, which terminates in a beveled stem tip portion 40 seatable on beveled portion 17 of cylindrical valve body member 11. The reduced-diameter portion 38 of valve stem member 34 is formed, near its lower end, with a peripheral, annular recess 41, within which is fitted a resilient O-ring 42 of rubber or a synthetic rubber-like material such as Neoprene. As illustrated, the O-ring 42 seals against the interior wall defined by reduced-diameter portion 15 of cylindrical valve body member 11 to prevent the escape of pressurized gas or fluid about the upper end of valve stem member 34.

Means is provided to prevent complete withdrawal of the valve stem member 34 once it has been assembled to the valve body member 11. To this end, a tubular lock collar 43 is provided, said lock collar being integrally formed with a reduced-diameter, externally-threaded portion 44 threadingly receivable within the internally-threaded upper end section 12 of the valve body member 11. The lower end of the internally-threaded portion 44 of the lock collar 43 terminates in short, thin-walled tip portion 45. The lock collar 43 is of such length and size that, when fully threaded and seated within the upper end of the valve body member 11, its tip portion 45 will have been forced inwardly along the inwardly-tapered shoulder 13 of said valve body member to terminate in blocking relation over the upper end of the second internally-threaded portion 14 of said valve body member thereby preventing unthreading withdrawal of valve stem member 34.

The valve stem member 34 is formed with a concentric, symmetrical, end-to-end, through opening comprising a slightly convergent, tapered bore 46 extending inwardly of the knob portion 35 and merging with a central, cylindrical bore 47 the inner end of which communicates with a reduced-diameter bore 48, their junction being defined by an upwardly-projecting, annular valve seat 49. The lower end of the reduced diameter bore 48 extends into a comparatively short bore 50, of slightly increased diameter.

Press fitted and frictionally retained within the valve stem member bore 50, is the upper end of a tubular spool valve inner sleeve member 51, the lower end of which is formed with an outwardly-flared, frusto-conical wall portion 52 extending into a short, increased-diameter, tubular portion 53. The frusto-conical wall portion 52 of spool valve inner sleeve member 51 is provided about its periphery with a plurality of through flow orifices 54, which may be of rectangular shape, for example, as illustrated.

Figure 3:
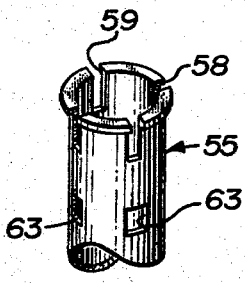
FIG. 3 is a partial view, in perspective, of the tubular spool valve outer sleeve member comprising the dispensing valve.

Assembled in interfitting communication with the lower end of the cylindrical valve body member 11 in the manner hereinafter more particularly described, is a tubular spool valve outer sleeve member 55, the upper end portion 56 of which has an outer diameter substantially equal to the reduced-diameter portion 16 of the valve body member 11, so as to be slidably receivable therein in the manner and for the purpose hereinafter appearing. The upper end spool outer sleeve upper end portion 56 terminates in a short, outwardly-extending, peripheral flange 57 of such size and shape as to be interfittingly received within the small, annular groove 18 in the valve body member 11. As illustrated in FIG. 3, the upper end of the outer sleeve member upper end portion 56 is longitudinally cross-slotted, as indicated at 58, 59, to allow for inward flexing upon assembly, as is hereinafter described.

The lower end of the upper end portion 56 of the spool valve sleeve member 55 merges with a comparatively short, convergent frusto-conical wall portion 60 which, in turn, extends into a concentric, reduced-diameter, tubular lower end portion 61. A synthetic plastic dip tube 62 is frictionally fitted over the tubular lower end portion 61, being of such length as to extend nearly to the bottom of the tank T in which the control valve is installed. The upper end portion 56 of spool valve outer sleeve member 55 is formed about its periphery with a plurality of through flow orifices 63, located to be in substantially horizontal alignment or registration with through flow orifices 54 in the spool valve inner sleeve member 51 when the valve stem member 34 is fully seated against annular valve seat 17 of valve stem member 34, as illustrated in FIG. 1.

Means is provided for the relief of excessively high gas pressure that could develop within the valve associated tank T under very high temperature conditions. To this end, the annular valve seat 49 formed within the cylindrical valve body member 11 at the upper end of reduced-diameter through bore 48 is normally sealed off by a cylindrical disc washer 64, which may be of a synthetic rubber such as Neoprene, for example, fitted within a cylindrical recess 65 at the lower end of a cylindrical guide stem 66. The guide stem 66 is formed with an annular shoulder 67 near its lower end, against which is seated a helical compression spring 68. The upper end of the helical compression spring 68 extends beyond the upper end of guide stem 66, and is constrained in place by means of a concave spring finger washer 69. When press fitted in place, the projecting fingers of the spring finger washer 69 seize against inner wall portions of the cylindrical bore 47 in valve stem member 34 to prevent removal. In operation, it will be understood that spring pressure afforded by helical compression spring 68 is such that the valve washer 64 will remain seated against annular valve seat 49 under all normal or safe pressure conditions within the tank T, but will move off the valve seat under excessive gas pressures to discharge through the cylindrical bore 47 and tapered bore 46 at the upper end of valve stem member 34.

In installation and use, the metal valve body member 11, without any of its associated separable parts, will be welded at its lower end to an appropriate opening in the tank T as by peripheral weld indicated at 70. After the valve body member 11 has cooled, the various other above-described valve components can be readily assembled as follows: the spool valve outer sleeve member 55 together with its friction-fitted dip tube 62 will first be assembled by pushing this assemblage through from the upper end of valve body member 11. Upon the peripheral flange 57 of the spool valve outer sleeve member 55 coming in contact with the short, beveled portion 17 defining the valve seat in the valve body member 11, further downward pressure will cause the slotted upper end portion thereof to flex inwardly until annular groove 18 is reached, whereupon the flange sections will spring into seating engagement therein to provide an interlocking connection. The spool inner sleeve member 51 will then be secured within bore 50 of valve stem member 34, and the O-ring 42 fitted in place in annular recess 41 as described above, whereupon the valve stem member assemblage will be screw fitted within the valve body member 11 to seat upon the valve seat defined by the short beveled portion 14, as described above. As also hereinabove described, the lock collar 43 will first have been circumjacently placed upon the valve stem member shank portion 36, finally to be threadingly assembled in interlocking relation within the internally-threaded, upper end section 12 of the valve body member 11 to prevent subsequent withdrawal of the valve stem member 34. The check valve ball 31 will then be placed within the central bore 24 of cylindrical dispensing port 21, after which the tapered plug 27 will be pressed into place within the tapered bore 25. It is to be noted that the tapered gradient is in the order of three degrees or less, constituting, a seize taper to provide for secure interfitting once the tapered plug has been press-fitted in place.

The valve stem member 34 will then be turned clockwise in the fully "off" position, whereat the beveled stem tip portion 40 thereof seats fully against the valve seat defined by the short beveled portion 17 within the valve body member 11, after which the dial indexing collar 20, which will have been placed circumjacent to the stem portion 56 of the valve stem member 34 before its adsembly to the cylindrical valve body member 11, will be rotationly adjusted so that its indexing projection 20*a* will be in vertical alignment with the indexing pointer 20 formed on the knob portion 35 of said valve stem member, and press-fitted in place about the upper end of the valve body member 11 to seat on outwardly-projecting circular flange portion 19.

In operation, upon turning of the valve stem portion knob 35 in the counter-clockwise or opening direction the first few turns, the beveled step tip portion 40 will unseat, permitting pressurized gas within the tank T to flow through the through flow orifices 63 in the spool sleeve outer member 55, and thence through bores 16 and 15 within the valve body member 11 for discharge through the cylindrical dispensing port 21. As the control knob 35 is further opened and the increased-diameter tube portion 53 of the spool valve inner sleeve member 51 begins to shut off communication through the spool valve outer sleeve member orifices 63, a combination of liquid and vapor will be dispensed, the liquid being forced through the bottom of the dip tube 62 and through the orifices 54 of the spool valve inner sleeve member 55. Upon further turning of the valve stem knob 35 in the "open" direction, the increased-diameter portion 53, being of sufficient length, will substantially fully close off the outer sleeve member orifices 63 so that only pressurized liquid will be dispensed from the bottom of the tank through dip tube 62. In this connection it is to be noted that the clearance of several thousandths of an inch between the outer diameter of the increased diameter portion 53 of the inner sleeve member 51, and the inner diameter of the upper end portion 56 of the spool valve outer sleeve member 55 is desirable to equalize any possible differential pressures due to pressure drop after the gas flows through orifices 63.

Figure 4:
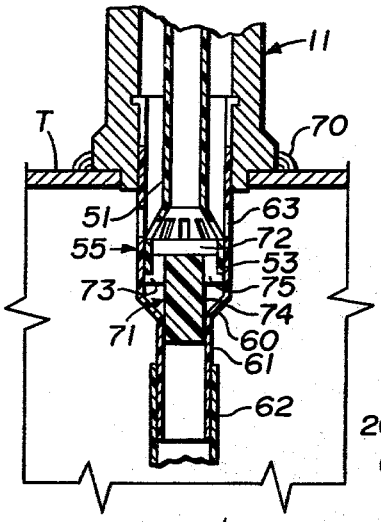
FIG. 4 is a partial vertical cross-sectional view of the valve assemblage illustrated in FIG. 1, illustrating a modification thereof.
Figure 2:
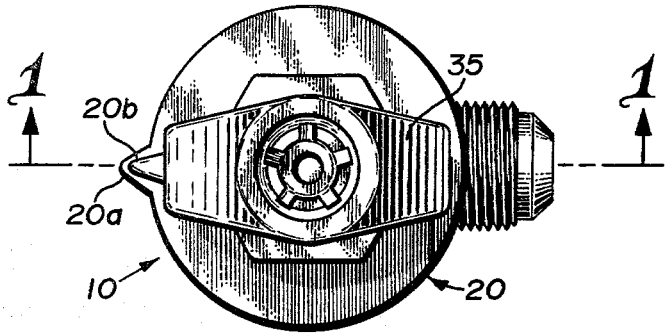
FIG. 2 is a top view of the dispensing valve, shown separately.
Figure 5:
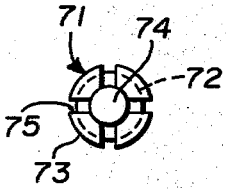
FIG. 5 is a bottom view of the piston member comprising the modification illustrated in FIG. 4.

FIGS. 4 and 5 illustrates a modification of the invention whereby dispensing of the liquid or a combination of the liquid and its vapor can be more precisely controlled. As illustrated, this modification consists of the attachment, to the lower end of the spool valve inner sleeve 51, of a piston member 71 comprising a cylindrical head portion 72 integrally formed at its lower end with an outwardly-projecting, peripheral flange 73 which extends into a coaxial, reduced-diameter cylindrical piston 74. The flanged head portion 72, 73 is vertically slotted to the diameter of the piston portion 74, as indicated at 75, four slots equidistantly spaced at 90 circular degrees preferably being provided, as illustrated, said slots providing for the through flow of the liquid to be dispensed as is hereinafter described. As illustrated in FIG. 4, the piston 74, which is of such diameter as to fit with a small clearance within tubular lower end portion of outer sleeve member 55, is also of such length that as the increased diameter tube portion 53 of inner sleeve member 51 begins to substantially completely close off outer sleeve member orifices 63 upon opening of the valve, the lower end of said piston will just have cleared the transition zone between said tubular lower end portion and the outer sleeve member frusto-conical wall portion 60. At this position of the valve stem the flow mixture of pressurized liquid to vapor can be accurately controlled, as can the rate of flow of the fluid being dispensed as the valve is further opened.

While I have illustrated and described herein only two forms in which my invention can conveniently be embodied in practice, it is to be understood that these are presented by way of example only and not in a limiting sense. My invention, in brief, comprises all the embodiments and modifications coming within the scope and spirit of the following claims.

What I claim as new and desire to secure by Letters Patent is:

1. A liquid and gas dispensing valve for pressurized supply tanks comprising, in combination, an integrally-formed, elongated valve body member having an end-to-end through opening, an annular valve seat intermediate the ends of said through opening, said through opening being internally threaded near one end of said valve body member, an elongated, cylindrical valve stem member receivable in said through opening and having an externally-threaded portion interthreadingly engagable with said internally-threaded portion of said valve body member, the inner end portion of said valve stem member defining an annular tip portion seatable on said annular valve seat, said valve body member comprising an outwardly-extending dispensing port having an internal bore communicating with said through opening in said valve body member at a position therealong between said annular valve seat and said internally-threaded portion, an elongated, tubular, inner sleeve member coaxially secured at one end to said inner end portion of said valve stem member and extensible outwardly of the other end of said valve body member, a tubular outer sleeve member, means securing one end portion of said outer sleeve member within said through opening of said valve body member at said other end thereof, in coaxial relation with respect to said inner sleeve member and extending outwardly thereof, peripheral side wall through opening means in the said outer sleeve member for the through flow of pressurized gas to be dispensed, said inner sleeve member at its outer end being formed with an increased-diameter cylindrical portion substantially circumjacent interior wall portions of said outer sleeve member and being operative to gradually block said through opening means in said outer sleeve member upon said valve stem member being unscrewed with respect to said valve body member from the seated position with respect thereto, said inner sleeve member being provided, inwardly of said increased-diameter portion thereof, with through opening means to permit the flow of pressurized liquid therethrough from the outer end of said outer sleeve member.

2. A liquid and gas dispensing valve as defined in claim 1 wherein said valve stem member is formed with an axial through opening communicating at its inner end with said one end of said inner sleeve member, and pressure relief valve means at the other end of said valve stem through opening for the relief of predetermined excess liquid or gas pressure applied through said inner and outer sleeve members.

3. A liquid and gas dispensing valve as defined in claim 1 wherein said valve body member is fabricated of steel, and wherein said means securing one end portion of said outer sleeve member within said through opening of said valve body member comprises an annular groove within said valve body member through opening near the other end thereof and a peripheral flange at the inner end of said outer sleeve member receivable in said annular groove, the inner end of said outer sleeve member being axially slotted to define radially resilient outer sleeve inner end portions capable of being inwardly flexed upon assembly of said outer sleeve member to said valve body member by pushing said outer sleeve member downwardly through said valve body member through opening at said one end thereof and past said annular valve seat for the interfitting of said annular flange portion in said annular groove.

4. A liquid and gas dispensing valve as defined in claim 2 wherein said inner and outer sleeve members and said valve stem members are fabricated of synthetic plastic materials receivable for assembly through said one end of said valve body through opening, whereby the other end of said valve body member may be welded to a communicating opening in a steel tank prior to assembly of the remaining valve parts without heating said remaining parts during welding.

5. A liquid and gas dispensing valve as defined in claim 4 and further including a steel tank defining a fully enclosed chamber for the storage of liquified gasses, said tank having a top wall portion with a through opening, said valve body member being welded at said other end thereof in circumjacent relation with respect to said tank through opening so that said inner and outer sleeve members can project down into said tank, said outer sleeve member including tubular extension means communicating with said outer end thereof and extending just short of the bottom of said tank.

6. A liquid and gas dispensing valve as defined in claim 5 wherein said outer sleeve tubular extension means comprises a dip tube the upper end of which is telescopingly secured with respect to an outer end portion of said outer sleeve member.

7. A liquid and gas dispensing valve as defined in claim 2 wherein said dispensing port comprises check valve means for preventing reverse flow therethrough.

8. A liquid and gas dispensing valve as defined in claim 3 including abutment lock means preventing unthreading withdrawal of said valve stem member after it has been assembled in interthreading engagement with respect to said valve body member.

9. A liquid and gas dispensing valve as defined in claim 8 wherein said valve stem member, at the outer end thereof, is integrally formed with a manual control knob having an indexing pointer, and an indexing collar rotatively adjustably positioned in coaxial relation with said one end of said body member for indicating the relative rotative position of said valve stem member with respect to said valve body member.

10. A pressurized liquid and gas dispensing valve as defined in claim 1 and further including a piston member fixed with respect to and extending outwardly of the outer end of said inner sleeve member, said piston member having a head portion extending outwardly of which is a reduced-diameter piston portion, said outer sleeve member, beyond said through openings therein, merging into an outwardly-extending, reduced-diameter portion within which said reduced diameter piston portion is slidingly receivable, said piston member comprising passageways for the through flow of pressurized liquid from the outside of said reduced-diameter piston portion to the inside of said inner sleeve member, the length of said piston portion being such as to withdraw from said reduced-diameter portion of said outer sleeve member upon said valve stem being unscrewed with respect to said valve body member to such an extent as to effect said blockage of said through opening means in said outer sleeve member.

* * * * *